US007559969B2

(12) United States Patent
Sanjurjo et al.

(10) Patent No.: US 7,559,969 B2
(45) Date of Patent: Jul. 14, 2009

(54) METHODS AND APPARATUSES FOR PRODUCING METALLIC COMPOSITIONS VIA REDUCTION OF METAL HALIDES

(75) Inventors: Angel Sanjurjo, San Jose, CA (US); Eugene Thiers, San Mateo, CA (US); Kai-Hung Lau, Cupertino, CA (US); Don L. Hildenbrand, Mountain View, CA (US); Gopala N. Krishnan, Sunnyvale, CA (US); Esperanza Alvarez, Menlo Park, CA (US)

(73) Assignee: SRI International, Menlo Park, CA (US)

( * ) Notice: Subject to any disclaimer, the term of this patent is extended or adjusted under 35 U.S.C. 154(b) by 613 days.

(21) Appl. No.: 10/913,688

(22) Filed: Aug. 6, 2004

(65) Prior Publication Data

US 2005/0097991 A1 May 12, 2005

Related U.S. Application Data

(60) Provisional application No. 60/504,369, filed on Sep. 19, 2003, provisional application No. 60/504,652, filed on Sep. 19, 2003.

(51) Int. Cl.

| | |
|---|---|
| ***C22B 34/12*** | (2006.01) |
| ***C22C 14/00*** | (2006.01) |
| ***C22C 33/04*** | (2006.01) |
| ***C22C 32/00*** | (2006.01) |

(52) U.S. Cl. ..... 75/359; 75/367; 75/613

(58) Field of Classification Search ..... 420/520, 420/417; 427/213, 217; 75/367, 359

See application file for complete search history.

(56) References Cited

U.S. PATENT DOCUMENTS

| | | | | |
|---|---|---|---|---|
| 2,874,040 | A | 2/1959 | Ferraro, Jr. | |
| 3,152,090 | A | 10/1964 | Cobel et al. | |
| 3,617,359 | A * | 11/1971 | Wakefield | 427/253 |
| 3,671,220 | A * | 6/1972 | Jonsson | 75/363 |
| 4,561,883 | A | 12/1985 | Müllner et al. | |

(Continued)

FOREIGN PATENT DOCUMENTS

| | | |
|---|---|---|
| GB | 723879 | 2/1955 |

OTHER PUBLICATIONS

Handbook of Chemistry and Physics, 54th edition. Robert C. Weast, Editor. 1973. pp. 4-10, 4-35, 4-38, 4-45, 4-88, and 4-101.*

*Primary Examiner*—George Wyszomierski
*Assistant Examiner*—Tima M McGuthry-Banks

(57) ABSTRACT

The present invention is generally directed towards a method for producing a solid metallic composition by reacting a gaseous metal halide with a reducing agent are described. In one embodiment, the method includes reacting a gaseous metal halide with a reducing agent in a manner effective to form a nonsolid reaction product, wherein the metal halide has the formula $MX_i$, in which M is a metal selected from a transition metal of the periodic table, aluminum, silicon, boron, and combinations thereof, X is a halogen, i is greater than 0, and the reducing agent is a gaseous reducing agent selected from hydrogen and a compound that releases hydrogen, and combinations thereof; and solidifying the reaction product, thereby forming a metallic composition comprising M that is substantially free from halides. The invention may be used to produce high-purity metallic compositions, particularly titanium particles and alloys thereof for use in powder metallurgy applications.

63 Claims, 3 Drawing Sheets

U.S. PATENT DOCUMENTS 4,830,665 A * 5/1989 Winand ..... 164/475
4,877,445 A 10/1989 Okudaira et al.
5,171,734 A * 12/1992 Sanjurjo et al. ..... 505/447
5,227,195 A * 7/1993 Sanjurjo ..... 427/248.1
5,259,862 A 11/1993 White et al.
5,503,655 A 4/1996 Joseph
5,779,761 A 7/1998 Armstrong et al.
5,855,678 A * 1/1999 Sanjurjo et al. ..... 118/715
5,935,293 A 8/1999 Detering et al.
5,958,106 A 9/1999 Armstrong et al.
6,143,361 A * 11/2000 Near et al. ..... 427/248.1
6,409,797 B2 6/2002 Armstrong et al.
6,475,428 B1 11/2002 Fraval et al.
6,699,305 B2 3/2004 Myrick
6,770,254 B2 * 8/2004 Bowen et al. ..... 423/492

* cited by examiner

METHODS AND APPARATUSES FOR PRODUCING METALLIC COMPOSITIONS VIA REDUCTION OF METAL HALIDES

CROSS-REFERENCE TO RELATED APPLICATIONS

This application claims priority under 35 U.S.C. §119(e)(1) to Provisional U.S. Patent Application Ser. Nos. 60/504,369 and 60/504,652, both filed Sep. 19, 2003. The disclosures of the aforementioned applications are incorporated by reference in their entireties.

ACKNOWLEDGEMENT OF GOVERNMENT SUPPORT

This invention was made with Government support under Contract No. MDA972-03-C-0032 awarded by the Defense Advanced Research Projects Agency. The Government has certain rights in this invention.

TECHNICAL FIELD

The present invention relates to methods and apparatuses for producing a solid metallic composition by reacting a gaseous metal halide with a reducing agent. More particularly, the invention relates to the use of such methods and apparatuses to produce high-purity metallic compositions. The invention is well suited for producing titanium particles and alloys thereof for use in powder metallurgy applications.

BACKGROUND OF THE INVENTION

Transition metals such as titanium are plentiful in earth's crust, occur in abundance in the form of oxides (e.g., as rutile-$TiO_2$ and ilmenite-$FeTiO_3$), and have highly useful properties. Titanium, in particular, is a metal suitable for applications that require a material having a low specific gravity, high relative strength and strength-to-weight ratio, even at high temperatures. For example, titanium metal has been used since the 1950s as a structural material, first in aerospace and defense applications. Subsequently, titanium has been used in chemical applications, to form biomedical prosthesis, and in leisure and sport equipment. In addition, titanium is generally highly resistant to corrosion, and often forms surface layers that are stable to chlorides and acids.

Like many other transition metals, however, titanium is generally considered difficult to process. It is expensive to extract and reduce from its ores, and relatively difficult to fabricate into useful products in view of its high melting point, and oxidation properties. In addition, metal powders having a precisely controlled composition and/or microstructure are typically required in powder metallurgy techniques such as hot isostatic processing. For transition metals such as titanium, known techniques for purification and powder preparation are relatively expensive, particularly if the metal is to be rendered suitable for advanced powder metallurgical manufacturing processes.

Two commercial multi-step titanium extraction processes coexisted until the early 1990s: the Kroll and the Hunter processes. Currently, titanium metal is typically produced by reducing titanium tetrachloride with molten magnesium or sodium metal in a steel batch retort. When $TiCl_4$ ("tickel") is mixed with the magnesium or sodium metal reducing agent, highly exothermic reactions occur, thereby producing a crude intermediate titanium "sponge." The sponge typically contains titanium metal as well as intimately mixed contaminants and by-products such as magnesium or sodium chloride, titanium subchlorides, and impurities originally present in the reducing agent. The titanium sponge is then refined to produce titanium ingots for manufacturing use. Sponge refining typically also involves costly processes such as the use of vacuum arc technologies.

Numerous titanium production paths have been proposed, and exemplary paths are listed in Table 1. They generally suffer from different drawbacks. For example, production paths that require chemical reduction of titanium compounds typically involve the formation of intermediate compounds that contain high levels of impurities. Purity, separation, oxidation and other issues associated with intermediate compounds may present technical and economic challenges. In particular, intermediate products formed by chemically reducing titanium halides tend to be highly contaminated with halides. Impurities such as oxides, carbon, and in some instances, nitrides may be formed as well. In addition, plasma thermal reduction of titanium chlorides utilizes heating to extremely high temperatures, and is accordingly very energy intensive. All of these processes are also disadvantageous since they are expensive.

Electrochemical processes also suffer from technical and economic disadvantages. While it is possible to deposit metallic Ti onto an electrode, such deposition typically must be carried out using a molten salt system. These electrochemical processes are typically associated with high energy cost as well as labor costs of removing and stripping the electrode onto which metallic Ti is deposited. Such costs represent substantial economic obstacles in commercializing electrolytic Ti processing techniques. Furthermore, molten salt processes typically require high current densities for high industrial throughputs. However, high current densities tend to favor dendrite growth. As a result, technical issues such as electrical shorts, separation from the melt, and product densification must be addressed in such molten salt processes.

In processes under development based on electrochemical deoxidation of $TiO_2$, for example, the use of molten chloride electrolytes typically containing $CaCl_2$ results in the production of fine Ti powder that is intermixed with the remaining calcium species. If this powder is then washed, a significant amount of surface titanium oxide is formed that must later be removed. Since it is difficult and expensive to remove oxygen below the about 300 ppm level required for most modern uses, the need for further cleaning and purification steps results in significantly increased costs.

TABLE 1

| PROCESS | REDUCING AGENT* | RESULTING PRODUCT* |
|---|---|---|
| Chemical Reduction of $TiCl_4$ | Na | Ti + NaCl |
| | Na and $AlCl_3$ | $Ti_iAl_j$ + NaCl |
| | Mg | Ti + $MgCl_2$ |
| | Al | Ti or $Ti_iAl_j$ + $AlCl_3$ |
| Electrochemical Reduction $TiX_i$ in a molten salt bath | $e^-$ | Ti + $X_2$ |
| Chemical Reduction of $TiF_4$ | Na | Ti + NaF |
| | Mg | Ti + $MgF_2$ |
| | Al | Ti + $AlF_3$ |
| Electrochemical Reduction of $TiF_4$ | $e^-$ | Ti sponge or powder + $F_2$ |
| Chemical Reduction of $TiI_4$ | Ti | Ti + $TiI_2$ + $I_2$ |
| Plasma Assisted Reduction of $TiO_2$ | $H_2 \rightarrow 2H$ | Ti + $H_2O$ |
| | C | Ti + CO ($TiO_iC$) |
| | C + N | TiN + 2CO |
| Chemical Reduction of $TiO_2$ | Ca | Ti(O) + $CaOTiO_2$ |
| | Al | $TiAl_i$ + ($Al_2O_3$), CaO, $TiO_2$ |

*Where X is a halogen such as F, Cl, Br, or I; $e^-$ indicates an electrochemical reduction; and i, j represent subscripts with different values.

Similarly, processes based on the reduction of titanium tetrachloride with an alkali or alkaline earth metal such as liquid sodium, e.g., according to the Armstrong et al. process of U.S. Pat. No. 6,409,797 also result in the production of fine titanium powders mixed with byproducts such as NaCl and excess reactants. Typically, such processes require additional means and process steps, e.g., elaborate systems of vacuum distillation and leaching, to provide clean titanium.

Processes utilizing fluidized bed reactors in which $TiCl_4$ is reduced by a gaseous metal such as Mg have also been disclosed. In U.S. Pat. No. 4,877,445 to Okudaira et al., for example, titanium pellets are produced by reducing titanium tetrachloride in vapor form using magnesium or sodium vapor as the reducing agent. However, the Okudaira et al. process requires the injection of reducing agent vapors and continuous operation at high temperature to recover, e.g., $MgCl_2$ as a condensable vapor. Impurities in the vapor reducing agent such as Mg will also appear at least to some degree in the titanium product. In addition, the use of magnesium results in titanium production costs similar to those of the Kroll process.

Once ingots are formed, a number of techniques may be used to produce parts having a complex geometry. For example, ingots may be melted, poured into a mold, cooled, and removed from the mold. Such casting processes are generally unsuited for low volume production runs due the cost of the molds. In addition, it is sometimes difficult to control the microstructure of parts made via casting processes. Alternatively, machining techniques may be used to selectively remove portions of ingots to produce parts of a desired shape. The removed portions of the ingot, of course, represent a source of waste. While powder metallurgy techniques have been developed that allow complex shapes to be formed quickly, titanium metal powders are currently quite expensive. Beside the costs associated with ingot production, powders incur the added costs associated with subsequent alloying and atomizing steps for producing uniform powders from the refined ingot.

Thus, there is a need in the art for technologies useful in lowering the cost associated with the production of high-purity metallic compositions, particularly for transition metals such as titanium and alloys thereof. In addition, there is a need to overcome the problems associated with known processes for producing metallic compositions that involve the production of halide-contaminated intermediate products by providing alternative, economically attractive methods for directly forming high-purity, dry and clean metallic granules, including the direct production of metal alloys, from metal halides. More particularly, it would be very desirable to provide a process for the direct production of titanium and titanium alloys in which there is no need to further clean and purify such metals using subsequent processing steps and wherein the cost is substantially reduced through the use of a cheap, abundant and clean reducing agent.

SUMMARY OF THE INVENTION

It is a general object of the present invention to overcome the afore-mentioned disadvantages of the prior art by providing improved methods and apparatuses for producing a solid metallic composition that is substantially free from halides, by reducing one or more metal halides.

Additional objects, advantages and novel features of the invention will be set forth in part in the description that follows, and in part will become apparent to those skilled in the art upon examination of the following, or may be learned by through routine experimentation during the practice of the invention.

In one embodiment, a method for producing a solid metallic composition is provided that involves reacting a gaseous metal halide with a reducing agent. The metal halide has the formula $MX_i$, M is a metal that includes transition metals of the periodic table, aluminum or boron, X is a halogen, and i is greater than 0. The reducing agent is typically, but not necessarily, gaseous, and may include, for example, hydrogen, a compound that releases hydrogen, and combinations thereof. A combination of reducing agents, or of metals M, may also be used. As a result, a nonsolid reaction product is formed, which is then solidified to form a metallic composition comprising M. The reaction product is preferably substantially free from halides. In another embodiment, the metallic composition formed by the method is substantially free from halides, oxygen, nitrogen, and carbon comprising M, the reducing element, and substantially no halides, oxygen, nitrogen, and carbon.

In an additional embodiment, a method for producing a solid metallic composition is provided, comprising reducing a metal subhalide by reaction with a gaseous reducing agent to form a nonsolid reaction product; and solidifying the reaction product, thereby forming a metallic composition comprising the metal that is substantially free from halides, oxygen, nitrogen, and carbon.

In another embodiment, titanium subhalide such as $TiCl_3$ is reduced to form a nonsolid reaction product, which is then solidified to form a metallic composition comprising Ti that is substantially free from halides, oxygen, and carbon. The metallic composition formed may be a Ti alloy or may consist essentially of pure Ti, depending on the reducing agents used and the reaction conditions. Suitable reducing agents include, for example, $H_2$, a compound that releases hydrogen, and combinations thereof.

In a further embodiment, a titanium halide is reacted with $H_2$ in a manner effective to form a nonsolid reaction product. Solidification of the reaction product results in the formation of metallic composition comprising Ti that is substantially free from halides, oxygen, nitrogen, and carbon. Again, the metallic composition may consist essentially of titanium or be a titanium alloy.

An apparatus for producing a metallic solid composition is also provided. The apparatus includes a source of a metal halide and a source of a reducing agent, as described above. A reactor in communication with the metal halide and the reducing agent sources is used to provide conditions effective to carry out a gas phase reaction between the metal halide and the reducing agent to form a nonsolid reaction product. Also included is a means for solidifying the reaction product to form a metallic composition. For example, the reactor may be comprised of a first reaction zone in fluid communication with the source of metal halide, and a second reaction zone downstream from the first reaction zone. In such a case, the first and second reaction zones may be maintained at different reaction temperatures.

DETAILED DESCRIPTION OF THE INVENTION

Figure 1:
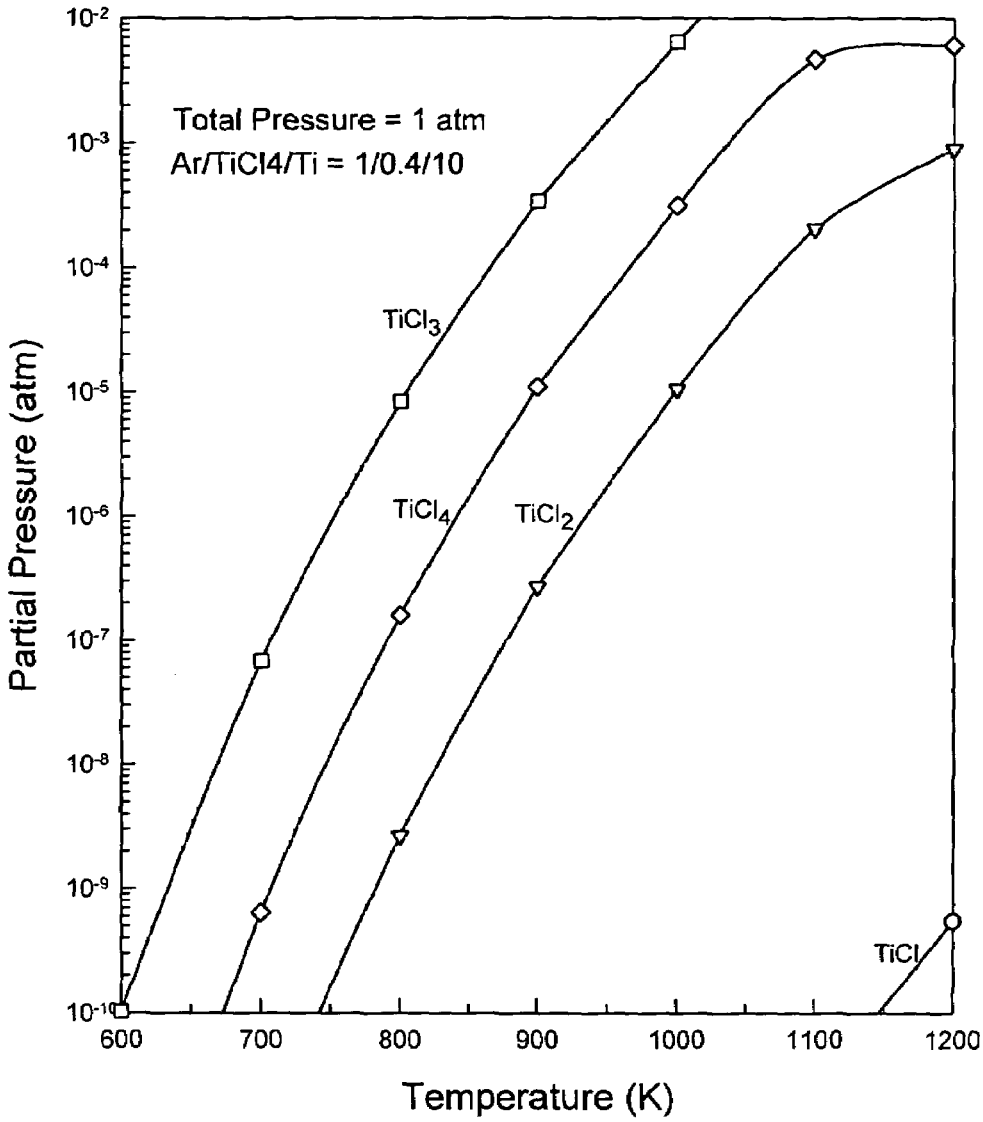
FIG. 1 shows the partial pressures of titanium subhalides in equilibrium with $TiCl_4$ and Ti as a function of temperature at 1 atm pressure as discussed in the detailed description.

Before describing the invention in detail, it must be noted that, as used in this specification and the appended claims, the singular forms "a," "an," and "the" include plural referents unless the context clearly dictates otherwise. Thus, for example, reference to "a reaction product" includes a single reaction product as well as combinations of reaction products, reference to "reducing agent" includes a single reducing agent as well as mixtures of reducing agents, and the like.

In describing and claiming the present invention, the following terminology will be used in accordance with the definitions set out below.

The term "group" as in "groups 4 to 7 of the period table" is used herein to refer to an assemblage of elements forming one of the vertical columns of the periodic table according to the International Union of Pure and Applied Chemistry (IUPAC). For example, titanium, zirconium and hafnium are members of group 4, and chromium, molybdenum and tungsten are members of group 7. In general, the term "transition metal" refers to an element selected from groups 3 to 12 of the periodic table.

"Optional" or "optionally" means that the subsequently described circumstance may or may not occur, so that the description includes instances where the circumstance occurs and instances where it does not The term "microstructure" is used herein to refer to a microscopic structure of a material and encompasses concepts such as lattice structure, degrees of crystallinity, dislocations, grain boundaries and the like.

The term "substantially free" as in the phrase "substantially free from halides," for example, refers to compositions that contain a low concentration of halides, e.g., less than about 5 atomic percent halides, preferably less than about 1 atomic percent halides. Still further, it is preferred that metallic compositions according to the invention are "substantially free" from halides in that they contain less than about 0.1 atomic percent of halides, more preferably less than about 0.01 atomic percent of halides, and most preferably less than about 0.001 atomic percent of halides. The same compositional limits also apply for other elements that may be present in small amounts such that the metallic composition is "substantially free" from these elements including, but not limited to, oxygen, nitrogen, and carbon.

The terms "consisting essentially" and "consists essentially," as in the phrase "consists essentially of pure Ti or a Ti alloy," are generally used in the context of their ordinary meanings. That is, by these terms it is meant that additional components materially affecting the basic and novel characteristics of the metallic compositions are to be excluded. For example, as concerns the presence of certain elements such as halides, oxygen, nitrogen, and carbon, these terms refer to metallic compositions that contain less than about 0.1 atomic percent of one or more of such halides, oxygen, nitrogen, and/or carbon.

In general, the invention provides an improved method for producing a solid metallic composition having a high purity or controlled alloying that involves reacting a gaseous metal halide with a reducing agent. As a result, a nonsolid reaction product is formed. After solidification, the reaction product forms the metallic composition. Unlike prior commercial processes such as the Kroll process, the inventive process does not require the formation of intermediate compounds containing high levels of halides. As a result, the metallic compositions produced by the inventive process typically do not need further purification and/or processing for use. In general, the invention may be practiced in conjunction with any halide of a transition metal. Of particular commercial and technical significance is the practice of the invention with metals selected from groups 4 to 7 of the periodic table. For example, the invention is particularly suited to form metallic compositions containing one or more metals selected from the group consisting of Ti, Zr, Hf, V, Nb, Ta, Cr, Mo, W, and Re. In addition, metal halides particularly suited for the practice of the invention include fluorides, chlorides, bromides, and iodides. Thus, for example, the inventive method may be used to produce metallic Ti and Ti alloys by reducing $TiCl_4$, $TiCl_3$, or $TiCl_2$, to produce metallic Zr and Zr alloys from Zr by reducing $ZrI_2$, to produce Hf and Hf alloys from $HfI_2$, and to produce V and V alloys from $VCl_4$.

Typically, the metal M is an element selected from groups 4 to 7 of the periodic table, although, in general, M is a transition metal, aluminum, silicon, boron, or a combination of metals. Exemplary elements include Ti, Zr, Hf, V, Nb, Ta, Cr, Mo, W, and Re, with Ti preferred. In addition, X may be selected from F, Cl, Br, I and combinations thereof. Exemplary reducing agents include hydrogen, either by itself or hydrogen produced from a compound that releases hydrogen. Suitable compounds that release hydrogen include without limitation NaH, $MgH_2$, $AlH_3$ and combinations thereof. To avoid the formation of nitrides, the reducing agent may not contain nitrogen. In addition, the reaction may be carried out in the presence of an alloying agent. For example, Ti alloys containing transition metals, V, Zr, Nb, or other elements such as Al, B, Sn, Fe, Si, or combinations thereof may be formed using a vaporizable metal halide that differs from $MX_i$. The metal halides used in the inventive method may share the same halide, or contain combinations of halides or different halides.

A number of different reaction schemes may be utilized to form metal or, more specifically, titanium-based compositions. For example, $TiX_4$ may be reacted with the reducing agent to form a subhalide, $TiX_3$. In turn, $TiX_3$ may be further reduced to form the reaction product. In some instances, $TiX_2$ may be used as a starting or intermediate material for reduction to form the reaction product.

Unlike processes that require plasma processing, the inventive reaction is typically carried out at a temperature less than about 1500° C. In some instances, the reaction temperature may be less than about 1300° C. or less than about 1300° C., or in the range of about 1100° C. to 1300° C. While the reduction of the metal halide is usually carried out as a gas-phase reaction, the metal halide may be initially provided in a nongaseous form, e.g., as liquid droplets and/or solid particles, and vaporized to effect the reaction. Similarly, the reducing agent may be provided in a nongaseous form, e.g., as liquid droplets, before the agent is vaporized.

The reaction product may be deposited (e.g. solidified) on any of a number of substrate surfaces. For example, the substrate may be comprised of a plurality of individual or agglomerated particles. In addition, substrate may be comprised of a material that is compositionally the same or different from the reaction product. When different in composition from the reaction product, the substrate material may have a higher melting point than the reaction product. The substrate may also be comprised of the reaction product. The solid metallic composition formed is typically, but not necessarily, produced in the form of a plurality of particles.

As noted, the metallic compositions of the invention are substantially free from halides. Typically, the metallic compositions contain no more than about 1 atomic percent of halides. In some instances, halides represent no more than about 0.1 atomic percent of the compositions. Under certain conditions, the halide content in the metallic compositions does not exceed about 0.01 atomic percent. In addition, the compositions are typically substantially free from the reducing agent and any element therefrom. Optimal reaction conditions will yield a metallic composition comprised of a plurality of particles that is substantially free from oxygen, nitrogen, and carbon as well as halides.

The method of the invention is not particularly limited to a specific reactor design or configuration and, in fact, a number of different reactor designs may be employed. For example, moving bed reactors, rotary kiln reactors, entrained reactors, falling wall reactors, and fluidized bed reactors may be used singly or in combination to carry out the inventive method. Typically, the reactor includes first and second reaction zones, wherein the first reaction zone is in fluid communication with the source of metal halide, and the second reaction zone is downstream from the first reaction zone. The first reaction zone may be located below or alongside the second reaction zone. In addition, the reaction zones may be located in a single chamber or in different chambers. In any case, the first and second reaction zones are typically maintained at different reaction temperatures.

The metal halide may be provided in gaseous form or in a nongaseous form wherein the metal halide is vaporized (prior to the reaction between the gaseous metal halide with the reducing agent) to effect the reaction between the gaseous metal halide and the reducing agent. For example, the metal halide may be provided as solid particles or as a liquid, such as in droplet form, before vaporization.

The reactor may be designed to collect and reuse any byproduct formed as a result of the inventive reaction. For example, when a halide byproduct is produced, a means may be provided to process the byproduct to recover a halogen gas. Similarly, when an element from the reducing agent is produced as a byproduct, the byproduct may be processed to recover the reducing agent. Preferably, the recovered reducing agent is reused to carry out the method in a continuous manner.

The invention is particularly well adapted to the production of spherical powders or granules of high-purity titanium alloys allowing for the use of standard powder processing techniques to form titanium alloy ingots. In this case, the overall method includes the purification of Ti by chemical vapor transport followed by redeposition of Ti and simultaneous reaction to form alloys with Al, V, or the other transition metals and elements noted above and as follows. One important aspect of the process is that it uses only low cost starting materials, minimum energy and a proven process technology to produce titanium alloy powders directly. In one embodiment, the method makes use of readily available and low cost starting material, $TiCl_4$, and reacts it at elevated temperatures with a low cost titanium sponge, titanium scrap or recently deposited Ti on the bed pellets to generate titanium subhalides ($TiCl_2$ and $TiCl_3$) in situ. These subhalides are then disproportionated and reduced in a manner effective to form the reaction product such as by reaction with hydrogen to produce titanium metal. Schematically, the chemical reactions involved include:

Generation of subhalides:

$$3TiCl_4(g)+Ti \rightarrow 4TiCl_3(g)$$

$$TiCl_4(g)+Ti \rightarrow 2TiCl_2(g)$$

Reduction or disproportionation of subhalides to titanium:

$$4TiCl_3(g)+6H_2(g) \rightarrow 4Ti+12HCl(g)$$

$$2TiCl_2(g)+2H_2(g) \rightarrow 2Ti+4HCl(g)$$

$$2TiCl_2(g) \rightarrow TiCl_4(g)+Ti$$

Based on experimentally determined values of thermochemical parameters for the titanium vapor species, the generation of titanium subhalides from the reaction of $TiCl_4$ with Ti as a function of temperature has been calculated and is shown in FIG. 1. These calculations show that $TiCl_4$ will react with Ti at relatively low temperatures and that $TiCl_3$ partial pressures can reach a value of 0.01 atm at temperatures as low as 750° C.

Figure 2:
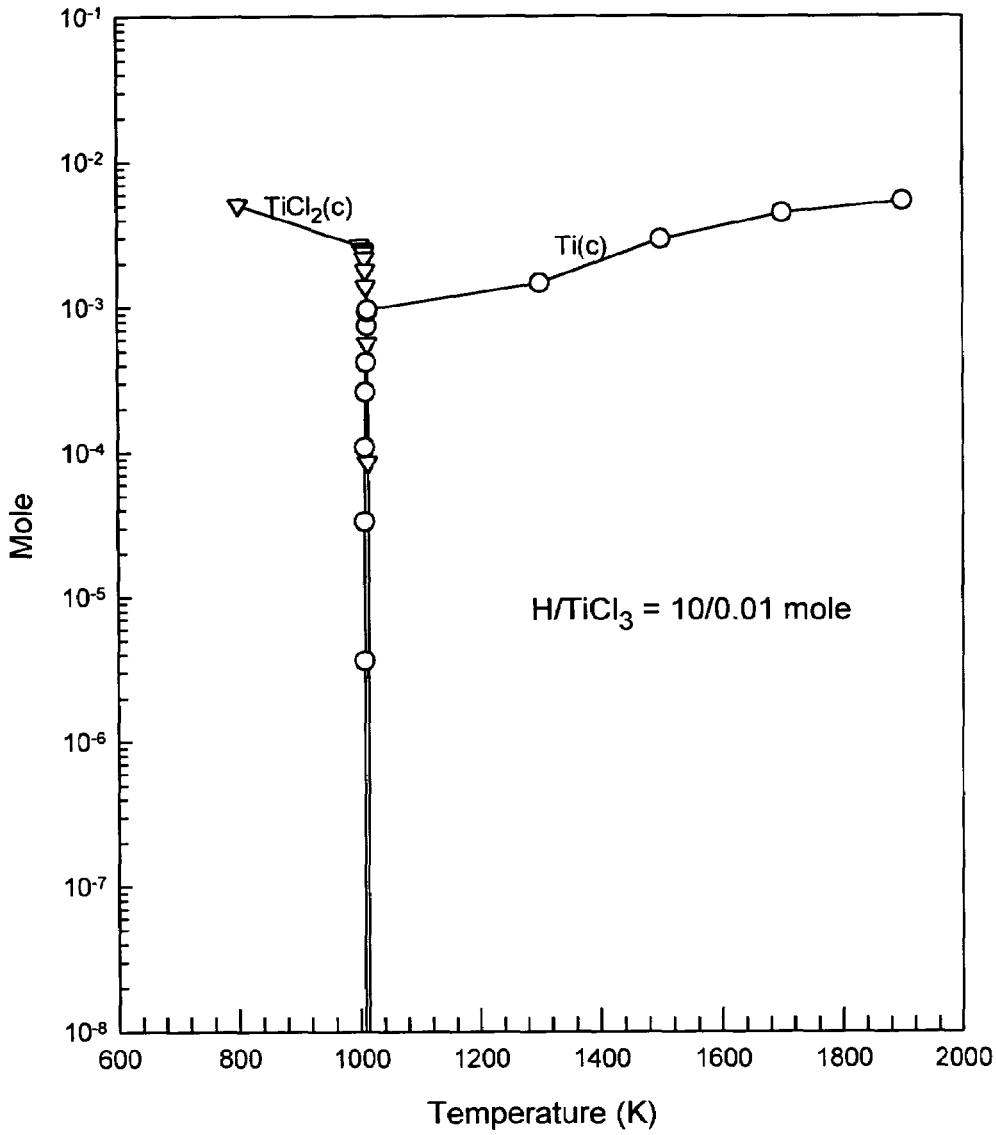
FIG. 2 depicts the reduction of $TiCl_3$ with $H_2$ to produce $TiCl_2$ or titanium metal compositions as discussed in the detailed description.

Similarly, the temperature necessary for the reduction of $TiCl_3$ with $H_2$ has been calculated as shown in FIG. 2. These calculations, made for a thin coating application, show that Ti metal can be deposited at temperatures as low as 750° C. However, for the rapid deposition of titanium required for commercial production and to reduce the $H_2$/Cl ratio needed for reduction, a temperature of at least about 1200° C. is generally necessary.

Figure 3:
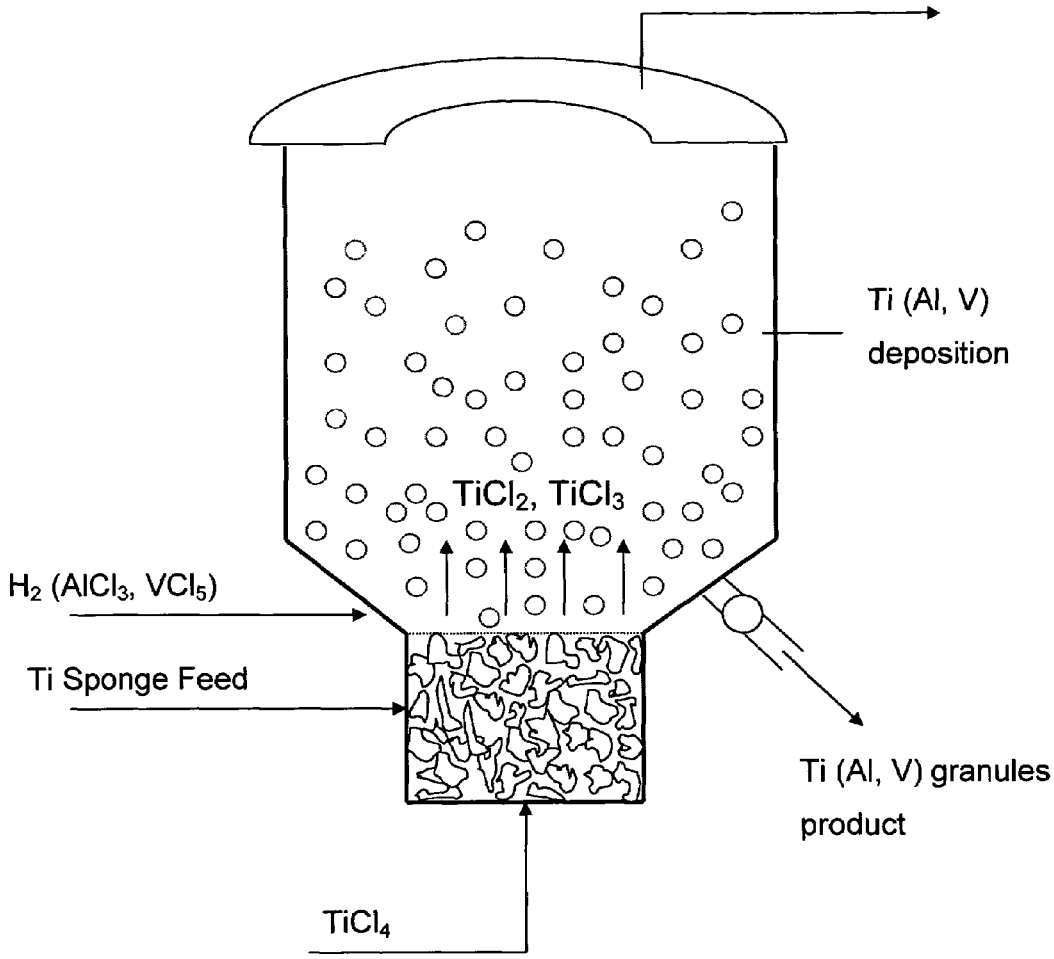
FIG. 3 shows a schematic diagram of a reactor for the production of Ti alloy powders as discussed in the detailed description.

In practice, and in accordance with one embodiment of the invention for producing titanium and titanium alloys, the generation of titanium subhalides may be performed by passing $TiCl_4$ over a hot fixed bed of titanium sponge and/or titanium scrap at a temperature in the range of about 900° to 1200° C. The vapors generated are mostly $TiCl_2$, $TiCl_3$, and unreacted $TiCl_4$. These vapors will be mixed with hydrogen (and Al, V, or other precursor vapors, if required for alloying purposes) and fed directly to an upper fluidized bed containing small (~100 μm diameter) seed particles of Ti as shown in FIG. 3. The upper fluidized bed may be kept at temperatures above that of the lower fixed bed. Uniform diameter, titanium or titanium alloy particles (0.1 to 5 mm, but preferably 0.5 to 2 mm diameter) in accordance with the invention are produced in the fluidized bed reactor and extracted. The product gases exit through the top of the reactor and are recycled to both minimize costs and minimize the environmental burden. It should be noted that the titanium in the resulting metallic powder may be derived from both the incident tickel and the titanium sponge and/or scrap. Advantageously, both of these are low-cost sources of titanium.

In a second embodiment, the $TiCl_4$ is reduced directly by H2 in the bed to form $TiCl_3$, which in turn, almost instantaneously is converted to Ti. While not intending to be limited thereto, all these reactions are thought to occur simultaneously in the reactor.

The formation of alloys is straightforward and one of the great advantages of the invention. Adding vapors of $AlCl_3$ or $VCl_4$ (also low-cost starting materials) to the $H_2$ stream results in the reduction of these halides on the surface of the titanium granules in the bed to form TiAl or TiAlV alloys (or many other desirable alloy compositions) according to $$Ti(c) + AlCl_3(gas) \xrightarrow{H_2} Al(Ti)(c) + TiCl_4(gas)$$

In some cases, the addition of a second reactant halide may act as an accelerator for the overall reaction. Such is the case when $VCl_4$ is added.

By controlling the partial pressure of the added vapors, powders of different compositions can be produced. Such powders may be produced in spherical form and ready for further processing by powder metallurgy. Although not limited thereto, the deposition of a wide variety of materials including titanium, chromium, silicon, aluminum, tungsten, niobium, zirconium, vanadium and other metal alloys such as titanium alloys having the general formula Ti-$M^i$ $M^{ii}$, where $M^i$ and $M^{ii}$ are metals including any transition metal, may also be carried out. Other particularly beneficial alloys that may be prepared according to the invention include, in the case of titanium, for example, Ti—V, Ti—Al, and Ti—Al—V alloys. More specifically, such titanium alloys include without limitation alpha or near alpha alloys such as Ti—Ni—Mo, Ti—Al—Sn, Ti—Al—Mo—V, Ti—Al—Sn—Zr—Mo—Si, Ti—Al—Nb—Ta—Mo, Ti—Al—Sn—Zr—Mo, Ti—Al—

Sn—Zr—Mo, and the like; alpha beta alloys such as Ti—Al, Ti—Al—V—Sn, Ti—Al—Mo, Ti—Al—Mo—Cr, Ti—Al—Sn—Zr—Mo, Ti—Al—Sn—Zr—Mo—Cr, Ti—V—Fe—Al, and the like; and beta alloys such as Ti—Mn, Ti—Mo—Zr—Sn, Ti—V—Fe—Al, Ti—V—Cr—Al—Sn, Ti—V—Cr—Al, Ti—Mo—V—Fe—Al, Ti—Al—V—Cr—Mo—Zr, and the like. Similarly, alloys of V, Nb, W, as well as the other metals noted above, may be prepared according to the inventive process.

The use of an atmospheric pressure fluidized bed chemical vapor deposition (FB-CVD) reactor leads to very high efficiency metal deposition due to the proven high heat and mass transfer available in the fluidized bed. Operation at atmospheric pressure both speeds the deposition process and minimizes costs associated with both low and high-pressure processes.

Impurities such as carbon and nitrogen in the titanium sponge (and scrap) should be relatively stable as carbide or nitride, and should not be transported in the gas-phase. While the fate of oxygen is less clear since, e.g., the formation of $TiOCl_2$ is possible, according to thermochemical calculations, the formation of such oxygen-containing compounds is not favored.

EXAMPLES

The following examples are included to provide those of ordinary skill in the art with a complete disclosure and description of how to make and use the compositions and methods of the invention. Efforts have been made to ensure accuracy with respect to numbers but some experimental error and deviations should, of course, be allowed for. Unless indicated otherwise, proportions are percent by weight, temperature is measured in degrees centigrade and pressure is at or near atmospheric. All components were obtained from commercially-available sources unless otherwise indicated.

For the purposes of demonstrating the direct production of metallic and metal alloy compositions, a fluidized bed reactor (FBR) was used. As generally depicted in FIG. 3, the FBR includes a bed powder (e.g., alumina having an approx. diameter of 150-175 μm or Si spheres), inlets for process gases such as hydrogen and titanium chloride and carrier gases such as Argon, exhaust outlets for removing waste gaseous reactants and product outlets for removing product metallic granules. Although not required, as further shown in FIG. 3, titanium sponge may be introduced as a particulate feed material. It is also possible, though not required, to utilize mixtures of such particulates, such as a mixture of titanium and vanadium chips introduced into the bottom of the FBR, in order to produce metallic alloy compositions. The recycling of vapors and/or resublimed vapors, such as resublimed $TiCl_3$ or $TiCl_3$ and $VCl_3$ vapors, was also provided through other inlets into the bottom of the FBR, typically along with an inert gas such as argon. Heating of the FBR was generally performed by the use of a graphite susceptor wrapped around the outside of the cylindrical wall of the FBR.

In general, the operating parameters of the FBR were selected as described in the following examples. As the skilled artisan will appreciate, these parameters are dependent on a variety of factors including the reaction and the type of reactor and may be necessarily varied according to the reaction kinetics as well as differences in reactor design. It is within the level of skill in the art to vary such parameters as needed without resorting to undue experimentation.

Example 1

Production of Titanium Granules

As described above, the FBR was operated by introducing $H_2$ (500 cc/min) and Ar (1200 cc/min) gas into the bottom of the FBR, providing a linear velocity in the bed of about 7 cm/sec. An alumina powder bed having a particle diameter of approx. 165 μm was used. The FBR was operated in the range of 1230-1250° C. Resublimed $TiCl_3$ and Ar (150 cc/min) were introduced into the bottom of the FBR. Results for run nos. 1 and 2 are shown below in Table 1.

TABLE 1

| Run No. | Fused $Al_2O_3$ (g) ($cm^2$) | $TiCl_3$ (g) (mole) Pi (atm) | $H_2$ (cc/min) (mol/min) (total mols) | Linear velocity (cm/s) | Run Time (min) | Thickness (μm) | Coated Color |
|---|---|---|---|---|---|---|---|
| 1 | 10 (920) | 0.56 | 500 | 7 | 30 | 0.42 | Dark Ti |
| | | $(3.63 \times 10^{-3})$ | $(2.06 \times 10^{-2})$ | | | | |
| | | ~0.01 atm | $(6.10 \times 10^{-1})$ | | | | |
| 2 | 8 (from run 1) | 1.06 | 500 | 7 | 40 | 1.0 | Darker Ti |
| | (733) | $(6.90 \times 10^{-2})$ | $(2.06 \times 10^{-2})$ | | | | |
| | | ~0.1 atm | $(8.10 \times 10^{-1})$ | | | | |

Example 2

Production of Titanium and Vanadium Granules

As described in Example 1 above, the FBR was operated by introducing $H_2$ (500 cc/min) and Ar (1200 cc/min) gas into the bottom of the FBR, providing a linear velocity of about 7 cm/sec. An alumina powder bed having a particle diameter of approx. 165 μm was used. Resublimed $TiCl_3$ and Ar (150 cc/min) were introduced into the bottom of the FBR. Results for run no. 3 in which $TiCl_3$ and $VCl_3$ were sequentially introduced into the FBR are shown below in Table 2. The total weight gain was 0.6 g, corresponding to an efficiency (i.e., the total weight gain divided by the sum of the Ti and V feed amounts) of about 90%.

TABLE 2

| Run No. | Fused $Al_2O_3$ (g) ($cm^2$) | $TiCl_3$ (g) (mole) Pi (atm) | $VCl_3$ (g) (mole) | $H_2$ (cc/min) (mol/min) (total mols) | Linear velocity (cm/s) | Run Time (min) | Thickness (μm) | Coated Color |
|---|---|---|---|---|---|---|---|---|
| 3 | 6.3 (from run 2) (577) | 1.27 ($8.21 \times 10^{-3}$) ~$10^{-2}$ atm | 0.87 ($5.53 \times 10^{-3}$) | 500 ($2.06 \times 10^{-2}$) ($8.10 \times 10^{-1}$) | 7 | 40 | 1.5 (Ti) 0.82 (V) | Metallic Gray Ti, V |

Example 3

Production of Vanadium Granules from Vanadium Tetrachloride

The FBR was operated by introducing $H_2$ (400 cc/min) and Ar (1200 cc/min) gas into the bottom of the FBR, providing a linear velocity of about 7 cm/sec. An alumina powder bed having a particle diameter of approx. 165 μm was used. The FBR was operated at 1250° C. Results for run no. 4 in which $VCl_4$ was introduced into the FBR are shown below in Table 3.

TABLE 3

| Run No. | Fused $Al_2O_3$ (g) ($cm^2$) | $VCl_4$ (g) (mole) | $H_2$ (mole) | Run Time (min) | Calculated Thickness (μm) | Film Composition by EDX (%) |
|---|---|---|---|---|---|---|
| 4 | 16 (1448) | $2.31 \times 10^{-2}$ | 2.45 | 120 | 1.4 (V) | 100 (V) |

Example 4

Production of Titanium/Aluminum/Vanadium Alloys

As described above, a study was undertaken to determine the feasibility of producing Ti—Al—V alloys. The FBR was operated according to the above examples in which $TiCl_3$, $VCl_3$, and $AlCl_3$ were introduced into the bottom of the FBR along with argon carrier gas. An alumina powder bed having a particle diameter of approx. 165 μm was used. The FBR was operated at 1250° C. Results for run nos. 5 and 6 are shown below in Table 4.

TABLE 4

| Run No. | Fused $Al_2O_3$ (g) ($cm^2$) | $TiCl_3$ (g) (mole) | $VCl_3$ (g) (mole) | $AlCl_3$ (g) (mole) | $H_2$ (cc/min) (mol/min) (total mols) | Linear velocity (cm/s) | Run Time (min) | Coated Color |
|---|---|---|---|---|---|---|---|---|
| 5 | 16 (1466) | 1.64 ($1.06 \times 10^{-2}$) | 0.42 ($2.67 \times 10^{-3}$) | 0.44 ($3.31 \times 10^{-3}$) | 500 ($2.06 \times 10^{-2}$) | 7 | 50 | Metallic Gray Ti, V, Al |
| 6 | 10 (from run 5) (1929) | 2.66 ($1.72 \times 10^{-2}$) | 0.69 ($2.38 \times 10^{-3}$) | 0.70 ($5.21 \times 10^{-3}$) | 500 ($2.06 \times 10^{-2}$) | 7 | 90 | Metallic Gray Ti, V, Al 36, 62, 2 |

Example 5

Production of Ti—V Alloys by Direct Reduction of Metal Tetrachloride with $H_2$

The FBR was operated according to the above examples in which $TiCl_4$ and $VCl_4$, were introduced into the bottom of the FBR along with argon carrier gas (in separate inlets of 250 cc/min that were mixed and supplied to the bottom of the FBR). Argon gas (250 cc/min) and $H_2$ (100 cc/min) were separately introduced into the bottom of the reactor. An alumina powder bed having a particle diameter of approx. 175-250 μm was used. The FBR was operated at 1350° C. Results for run nos. 7-10 are shown below in Table 5.

TABLE 5

| Run No. | Fused $Al_2O_3$ (g) ($cm^2$) | $TiCl_4$ (g) (mole) | $VCl_4$ (g) (mole) | $H_2$ (mole) | Measured Thickness (μm) | Film Composition by EDX (%) |
|---|---|---|---|---|---|---|
| 7 | 7 (641) | $9.4 \times 10^{-2}$ | $7.2 \times 10^{-3}$ | 12.3 | — | 75 (Ti)<br>24 (V) |
| 8 | 7 (641) | 0.11 | 0.13 | 12.3 | — | 19 (Ti)<br>81 (V) |
| 9 | 19.2 (1759) | 0.11 | 0.003 | 12.3 | — | 90 (Ti)<br>10 (V) |
| 10 | 17.3 (from run 9) (1429) | 1.24 | 0.0142 | 48.9 | 3 | 97 (Ti)<br>3 (V) |

Example 6

Production of Ti—V Alloys by Direct Reduction of Metal Tetrachloride with $H_2$ Using a Central $H_2$ Inlet The FBR was operated according to Example 5 above in which $TiCl_4$ and $VCl_4$, were introducted into the bottom of the FBR along with argon carrier gas (in separate inlets of 300 and 200 cc/min, respectively, that were mixed and supplied to the bottom of the FBR). Argon gas (250 cc/min) and $H_2$ (1500 cc/min) were separately introduced into the bottom of the reactor. A separate $H_2$ stream (250 cc/min) was introduced into the center of the FBR. An alumina powder bed having a particle diameter of approx. 175-250 μm was used. The FBR was operated at 1350° C. Results for run nos. 11 and 12 are shown below in Table 6.

TABLE 6

| Run No. | Fused $Al_2O_3$ (g) ($cm^2$) | $TiCl_4$ (g) (mole) | $VCl_4$ (g) (mole) | $H_2$ (mole) | Measured Thickness (μm) | Film Composition by EDX (%) |
|---|---|---|---|---|---|---|
| 11 | 16 (1343) | 1.19 | 0.0127 | 40.26<br>6.75* | 6 | 95 (Ti)<br>5 (V) |
| 12 | 26.2 (2084) | 0.594 | 0.0138 | 43.9<br>7.37* | 3 | 94 (Ti)<br>7 (V) |

*$H_2$ introduced into the FBR via the central tube inlet

Example 7

Production of Ti—V Alloys by Direct Reduction of Metal Tetrachloride with $H_2$ Using a Central $H_2$ Inlet The FBR was operated according to Example 6 above in which $TiCl_4$ and $VCl_4$, were introduced into the bottom of the FBR along with argon carrier gas (in separate inlets of 300 and 200 cc/min, respectively, that were mixed and supplied to the bottom of the FBR). Argon gas (250 cc/min) and $H_2$ (1500 cc/min) were separately introduced into the bottom of the reactor. A separate $H_2$ stream (250 cc/min) was introduced into the center of the FBR. The bed contained Si sphere particles having a particle diameter of approx. 650 μm. The FBR was operated at 1260° C. Results for run no. 13 are shown below in Table 7.

TABLE 7

| Run No. | Fused $Al_2O_3$ (g) ($cm^2$) | $TiCl_4$ (g) (mole) | $VCl_4$ (g) (mole) | $H_2$ (mole) | Measured Thickness (μm) | Film Composition by EDX (%) |
|---|---|---|---|---|---|---|
| 13 | 23.2 (917) | 0.419 | 0.0126 | 99.052<br>23.575* | 35 | 50 (Ti)<br>46 (Si)<br>3.3 (V) |

*$H_2$ introduced into the FBR via the central tube inlet

All patents, publications, and other published documents mentioned or referred to herein are incorporated by reference in their entireties.

It is to be understood that while the invention has been described in conjunction with the certain specific embodiments thereof, that the foregoing description as well as the examples, are intended to illustrate and not limit the scope of the invention. It should be further understood by those skilled in the art that various changes may be made and equivalents may be substituted without departing from the scope of the invention, and further that other aspects, advantages and modifications will be apparent to those skilled in the art to which the invention pertains.

What is claimed is:

1. A method for producing a solid metallic alloy composition, comprising:

(a) reacting a gaseous metal halide with a reducing agent in a manner effective to form a nonsolid reaction product, wherein the gaseous metal halide has a formula MXi, wherein M is a metal selected from a transition metal of the periodic table, aluminum, silicon, boron, and combinations thereof, X is a halogen, i is greater than 0, the reducing agent is a gaseous reducing agent selected from hydrogen, a compound that releases hydrogen, and combinations thereof, and the reacting is carried out in a presence of an alloying agent or a precursor thereof; and (b) solidifying the nonsolid reaction product, thereby forming a metallic alloy composition comprising M that is substantially free from halides, wherein the nonsolid reaction product is deposited on a surface of a substrate during step (b).

2. The method of claim 1, wherein M is selected from groups 4 to 7 of the periodic table.

3. The method of claim 2, wherein M is an element selected from Ti, Zr, Hf, V, Nb, Ta, Cr, Mo, W, and Re.

4. The method of claim 3, wherein M is Ti.

5. The method of claim 1, wherein X is selected from F, Cl, Br, I and combinations thereof.

6. The method of claim 5, wherein X is Cl.

7. The method of claim 1, wherein the reducing agent is H2.

8. The method of claim 1, wherein the reducing agent is a compound that releases hydrogen.

9. The method of claim 8, wherein the compound that releases hydrogen is selected from NaH, MgH2, AlH3 and combinations thereof.

10. The method of claim 1, wherein the metallic alloy composition formed is an alloy of Ti.

11. The method of claim 10, wherein the alloy contains a transition metal, Al, B or a combination thereof.

12. The method of claim 1, wherein the alloying agent or precursor thereof is a vaporizable metal halide that differs from MXi.

13. The method of claim 12, wherein the metal halides contain the same halide.

14. A method for producing a solid metallic alloy composition, comprising:

(a) reacting a gaseous metal halide with a reducing agent in a manner effective to form a nonsolid reaction product, wherein the gaseous metal halide has a formula MXi, wherein M is titanium (Ti), X is a halogen, i is greater than 0, the reducing agent is a gaseous reducing agent selected from hydrogen, a compound that releases hydrogen, and combinations thereof, and the reacting is carried out in a presence of an alloying agent or a precursor thereof, wherein step (a) is comprised of:

(a') reacting TiX4 with the reducing agent to form a titanium subhalide; and (a") reducing the titanium subhalide formed in step (a') in a manner effective to form the nonsolid reaction product, and (b) solidifying the nonsolid reaction product, thereby forming a metallic alloy composition comprising M that is substantially free from halides.

15. A method for producing a solid metallic alloy composition, comprising:

(a) reacting a gaseous metal halide with a reducing agent in a manner effective to form a nonsolid reaction product, wherein the gaseous metal halide has a formula MXi, wherein M is titanium (Ti), X is a halogen, i is greater than 0, the reducing agent is a gaseous reducing agent selected from hydrogen, a compound that releases hydrogen, and combinations thereof, and the reacting is carried out in a presence of an alloying agent or a precursor thereof, wherein step (a) is carried out by reacting TiX3 with the reducing agent in a manner effective to form the nonsolid reaction product, and (b) solidifying the nonsolid reaction product, thereby forming a metallic alloy composition comprising M that is substantially free from halides.

16. A method for producing a solid metallic alloy composition, comprising:

(a) reacting a gaseous metal halide with a reducing agent in a manner effective to form a nonsolid reaction product, wherein the gaseous metal halide has a formula MXi, wherein M is titanium (Ti), X is a halogen, i is greater than 0, the reducing agent is a gaseous reducing agent selected from hydrogen, a compound that releases hydrogen, and combinations thereof, and the reacting is carried out in a presence of an alloying agent or a precursor thereof, wherein step (a) is carried out by reacting at least TiX2 with the reducing agent in a manner effective to form the nonsolid reaction product, and (b) solidifying the nonsolid reaction product, thereby forming a metallic alloy composition comprising M that is substantially free from halides.

17. The method of claim 14, wherein step (a") is carried out in the presence of the alloying agent.

18. The method of claim 4, wherein step (a) is carried out at a temperature less than about 1500° C.

19. The method of claim 18, wherein step (a) is carried out at a temperature less than about 1300° C.

20. The method of claim 19, wherein step (a) is carried out at a temperature less than about 1100° C.

21. The method of claim 1, wherein the substrate is comprised of a plurality of particles.

22. The method of claim 21, wherein the particles are agglomerated.

23. The method of claim 1, wherein the substrate is comprised of a material that is compositionally different from the nonsolid reaction product.

24. The method of claim 23, wherein the substrate is comprised of a material that has a higher melting point than the nonsolid reaction product.

25. The method of claim 23, wherein the substrate is comprised of the nonsolid reaction product.

26. The method of claim 1, wherein the metallic alloy composition contains no more than about 0.1 atomic percent of halides.

27. The method of claim 26, wherein the metallic alloy composition contains no more than about 0.01 atomic percent of halides.

28. The method of claim 27, wherein the metallic alloy composition contains no more than about 0.001 atomic percent of halides.

29. The method of claim 1, wherein the metallic alloy composition is substantially free from oxygen, nitrogen and carbon.

30. The method of claim 1, wherein the metallic alloy composition is substantially free from the reducing agent and any element therefrom.

31. A method for producing a solid metallic alloy composition, comprising:

(a) reacting a gaseous metal halide with a reducing agent in a manner effective to form a nonsolid reaction product, wherein the gaseous metal halide has a formula MXi, wherein M is a metal selected from a transition metal of the periodic table, aluminum, silicon, boron, and combinations thereof, X is a halogen, i is greater than 0, the reducing agent is a gaseous reducing agent selected from hydrogen, a compound that releases hydrogen, and combinations thereof, and the reacting is carried out in a presence of an alloying agent or a precursor thereof; and (b) solidifying the nonsolid reaction product, thereby forming a metallic alloy composition comprising M that is substantially free from halides, wherein the solid metallic alloy composition formed is comprised of a plurality of particles.

32. The method of claim 1, further comprising, before step (a), providing the metal halide in a nongaseous form and vaporizing the metal halide to effect the reaction of step (a).

33. The method of claim 32, wherein the metal halide is provided as a liquid or solid before vaporization.

34. The method of claim 33, wherein the liquid is provided in droplet form before vaporization.

35. The method of claim 1, further comprising, before step (a), providing the reducing agent in a nongaseous form and vaporizing the reducing agent to form a gaseous reducing agent and to effect the reaction to occur between the gaseous metal halide and the gaseous reducing agent.

36. A method for producing a solid metallic alloy composition, comprising:

(a) reacting a gaseous metal halide with a reducing agent in a manner effective to form a nonsolid reaction product, wherein the gaseous metal halide has a formula MXi, wherein M is a metal selected from a transition metal of the periodic table, aluminum, silicon, boron, and combinations thereof, X is a halogen, i is greater than 0, the reducing agent is a gaseous reducing agent selected from hydrogen, a compound that releases hydrogen, and combinations thereof, and the reacting is carried out in a presence of an alloying agent or a precursor thereof, wherein before step (a), providing the reducing agent in a nongaseous form and vaporizing the reducing agent to form a gaseous reducing agent and to effect the reacting to occur between the gaseous metal halide and the gaseous reducing agent, wherein the metal halide is provided as solid particles or liquid droplets before vaporization; and (b) solidifying the nonsolid reaction product, thereby forming a metallic alloy composition comprising M that is substantially free from halides.

37. The method of claim 1, carried out using an apparatus comprising a reactor selected from chemical vapor deposition reactors, moving bed reactors, rotary kiln reactors, vibrating reactors, entrained reactors, falling wall reactors, fluidized bed reactors, and fixed bed reactors.

38. The method of claim 37, wherein the reactor is comprised of a first reaction zone in fluid communication with a source of metal halide, and a second reaction zone downstream from the first reaction zone, wherein the first and second reaction zones are maintained at different reaction temperatures.

39. The method of claim 38, wherein the first reaction zone is located below the second reaction zone.

40. The method of claim 38, wherein the first reaction zone is located alongside the second reaction zone.

41. The method of claim 38, wherein the reaction zones are located in a single chamber.

42. The method of claim 38, wherein each of the first and second reaction zones is located in a different chamber.

43. The method of claim 1, wherein a byproduct formed during step (a) is collected.

44. The method of claim 43, wherein the byproduct is comprised of a halide.

45. The method of claim 44, wherein the byproduct is processed to recover a halogen gas.

46. The method of claim 43, wherein the byproduct is comprised of an element from the reducing agent.

47. The method of claim 43, wherein the byproduct is processed to recover the reducing agent.

48. The method of claim 43, wherein the reducing agent is H2.

49. The method of claim 47, wherein the recovered reducing agent is reused to carry out the method.

50. A method for producing a solid metallic alloy composition, comprising:

(a) reducing a metal subhalide in a presence of an alloying agent or a precursor thereof by reaction with a gaseous reducing agent selected from H2, a compound that releases hydrogen, and combinations thereof, to form a nonsolid reaction product; and (b) solidifying the nonsolid reaction product, thereby forming a metallic alloy composition comprising a metal that is substantially free from halides, oxygen, nitrogen, and carbon, wherein the nonsolid reaction product is deposited on a surface of a substrate during step (b).

51. The method of claim 50, wherein the metal is selected from Groups 4 to 7 of the periodic table.

52. The method of claim 51, wherein the metal is an element selected from Ti, Zr, Hf, V, Nb, Ta, Cr, Mo, W, and Re.

53. The method of claim 52, wherein the metal is Ti.

54. The method of claim 50, wherein the halide is selected from F, Cl, Br, I and combinations thereof.

55. The method of claim 54, wherein the halide is Cl.

56. The method of claim 50, wherein the gaseous reducing agent comprises H2.

57. The method of claim 50, wherein the metallic alloy composition consists essentially of Ti.

58. The method of claim 50, wherein the metallic alloy composition is a Ti alloy.

59. A method for producing a solid metallic alloy composition, comprising:

(a) reducing a titanium (Ti) subhalide in a presence of an alloying agent or a precursor thereof by reaction with a gaseous reducing agent selected from H2, a compound that releases hydrogen, and combinations thereof, to form a nonsolid reaction product, wherein step (a) is carried out by reducing TiCl3 with said reducing agent selected from H2, a compound that releases hydrogen, and combinations thereof; and (b) solidifying the nonsolid reaction product, thereby forming a metallic alloy composition comprising titanium that is substantially free from halides, oxygen, nitrogen, and carbon.

60. A method for producing a solid metallic alloy composition, comprising:

(a) reacting a Ti halide with H2, in a presence of an alloying agent or a precursor thereof, in a manner effective to form a nonsolid reaction product; and (b) solidifying the nonsolid reaction product, thereby forming a metallic alloy composition comprising Ti that is substantially free from halides, oxygen, and carbon, wherein the nonsolid reaction product is deposited on a surface of a substrate during step (b).

61. The method of claim 60, wherein the metallic alloy composition consists essentially of pure Ti.

62. The method of claim 60, wherein the metallic alloy composition is a Ti alloy.

63. A method for producing a solid metallic alloy composition, comprising:

(a) reacting a gaseous metal halide with a reducing agent in a manner effective to form a nonsolid reaction product, wherein the gaseous metal halide has a formula $$MX_i,$$

wherein M is a metal selected from a transition metal of the periodic table, aluminum, silicon, boron, and combinations thereof, X is a halogen, i is greater than 0, the reducing agent is a gaseous reducing agent selected from hydrogen, a compound that releases hydrogen, and combinations thereof, and the reacting is carried out in a presence of an alloying agent or a precursor thereof; and (b) solidifying the nonsolid reaction product, thereby forming a metallic alloy composition that is substantially free from halides, oxygen, nitrogen, and carbon comprising M, the reducing element, and substantially no halides, oxygen, nitrogen, and carbon, wherein the nonsolid reaction product is deposited on a surface of a substrate during step (b).

* * * * *